US009986851B2

(12) United States Patent
Walton et al.

(10) Patent No.: US 9,986,851 B2
(45) Date of Patent: Jun. 5, 2018

(54) DOUBLE ENDED CUP DISPENSER

(71) Applicant: Cardomon International Limited, Tsimshatsui, Kowlon (HK)

(72) Inventors: Philip A. Walton, Bishop Auckland (GB); Andrew Smith, Hamsterley (GB)

(73) Assignee: Cardomon International Limited, Hong Kong (HK)

( * ) Notice: Subject to any disclaimer, the term of this patent is extended or adjusted under 35 U.S.C. 154(b) by 0 days. days.

(21) Appl. No.: 14/705,052

(22) Filed: May 6, 2015

(65) Prior Publication Data

US 2016/0324333 A1 Nov. 10, 2016

(51) Int. Cl.
*A47F 1/00* (2006.01)
*A47F 1/06* (2006.01)
*A47F 1/08* (2006.01)

(52) U.S. Cl.
CPC ..... *A47F 1/065* (2013.01); *A47F 1/085* (2013.01)

(58) Field of Classification Search
CPC ..... A47F 1/065; A47F 1/085; B67D 1/06; B65D 83/0481; B65D 41/005; B65D 41/46; B65D 83/0427
USPC ..... 221/246, 96
See application file for complete search history.

(56) References Cited

U.S. PATENT DOCUMENTS 1,808,284 A * 6/1931 Bergmann ..... A47F 1/085 221/304
1,975,649 A * 10/1934 Reifsnyder ..... A47F 1/085 221/308
3,203,587 A * 8/1965 Mount ..... A47F 1/085 221/279
3,265,243 A 8/1966 Velter
3,420,406 A 1/1969 Graham
4,033,478 A * 7/1977 House ..... G07F 11/16 221/279
4,126,248 A * 11/1978 House ..... G07F 11/16 221/241

(Continued)

FOREIGN PATENT DOCUMENTS

GB 1058563 2/1967
GB 1058563 A * 2/1967 ..... B65D 83/00
WO WO 8302441 A1 * 7/1983 ..... B65D 83/00

*Primary Examiner* — Rakesh Kumar
(74) *Attorney, Agent, or Firm* — Merek, Blackmon & Voorhees, LLC

(57) ABSTRACT

A dispenser configured to simultaneously dispenses a plurality of liquid retaining members from a plurality of different areas of the dispenser. Preferably, the liquid retaining members are drinking cups. Preferably, the dispenser is configured to simultaneously dispense a first stack of a plurality of drinking cups and a second stack of a plurality of drinking cups from corresponding ends of the dispensers. The dispenser includes a body having a first end and a second end. The first end has a first opening through which drinking cups in the first stack of a plurality of drinking cups can be individually dispensed one after the other. The second end has a second opening through which drinking cups in the second stack of drinking cups can be individually dispensed one after the other. Preferably, at least one biasing member biases the first stack of a plurality of drinking cups towards the first end of the body and biases the second stack of a plurality of drinking cups towards the second end of the body.

17 Claims, 10 Drawing Sheets

(56) References Cited

U.S. PATENT DOCUMENTS 4,199,076 A * 4/1980 Brown ..... G07F 11/16 221/45
4,927,053 A * 5/1990 Mayfield, III ..... A47F 1/065 221/279
4,953,746 A * 9/1990 Andriash ..... B65D 83/0817 221/35
5,839,605 A * 11/1998 Hadtke ..... A47F 1/065 221/279
6,866,166 B2 * 3/2005 Mehes ..... A47F 1/085 222/132
7,011,231 B2 * 3/2006 Boykin ..... A47F 1/123 221/303
7,325,701 B1 * 2/2008 Meyer ..... A47F 1/065 221/221
2001/0032860 A1 * 10/2001 Roethel ..... A47F 1/065 221/282
2004/0065672 A1 * 4/2004 Kaplan ..... A47F 1/106 221/303
2004/0158966 A1 * 8/2004 Roethel ..... A47F 1/065 29/413
2005/0077314 A1 * 4/2005 Boykin ..... A47F 1/123 221/307
2006/0060490 A1 * 3/2006 Rodriguez ..... B65D 5/04 206/494
2011/0284572 A1 * 11/2011 Meyer ..... A47F 1/065 221/251
2014/0076917 A1 * 3/2014 Siebel ..... A47K 10/427 221/35
2014/0312057 A1 * 10/2014 Meyer ..... A47F 1/065 221/304
2015/0250290 A1 * 9/2015 Holloway ..... A45D 40/24 401/31
2016/0324333 A1 * 11/2016 Walton ..... A47F 1/065

* cited by examiner

Figure 14
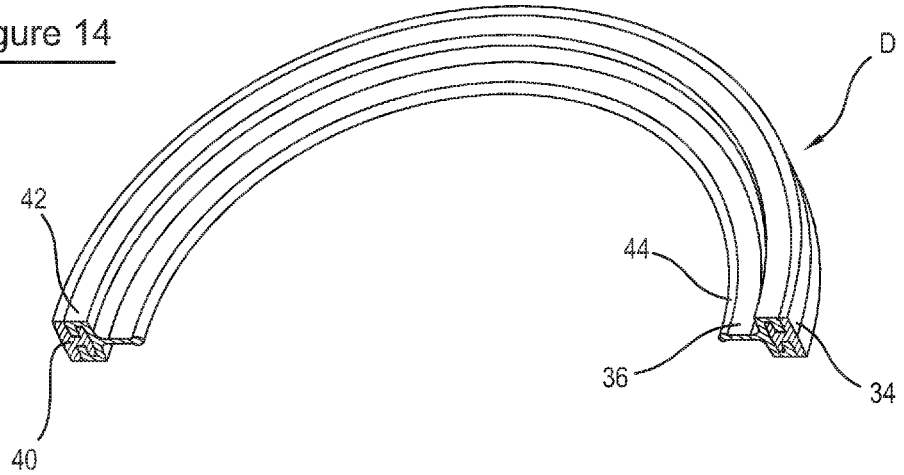
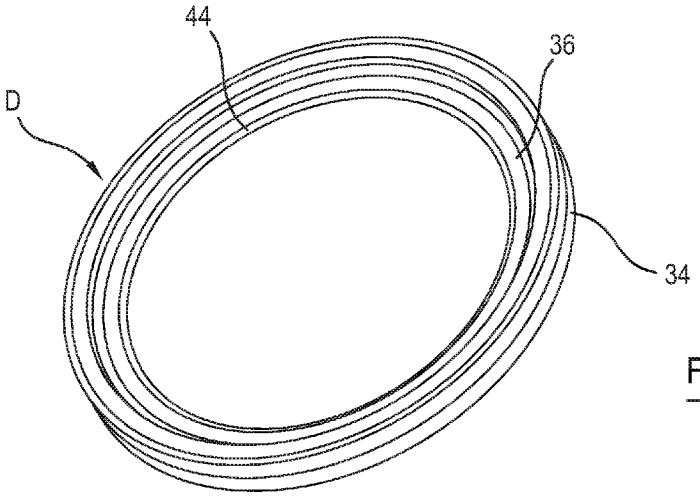
Figure 15
Figure 16
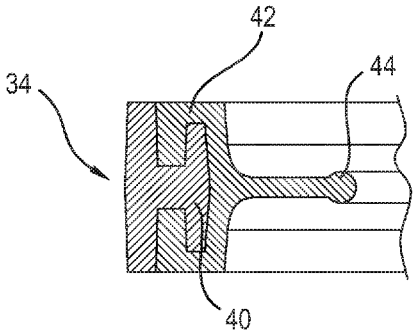

DOUBLE ENDED CUP DISPENSER

FIELD OF THE INVENTION

The present invention is directed to a dispensing apparatus for simultaneously dispensing liquid retaining members from a plurality of different portions or areas of the dispensing apparatus.

BACKGROUND OF THE INVENTION

Previously developed dispensers for dispensing liquid retaining members (e.g., drinking cups) have a number of disadvantages and/or limitations. Cup dispensers have been configured to dispense a stack of drinking cups using gravity. However, such gravity type cup dispensers require individual drinking cups from a stack of drinking cups housed in the cup dispenser to be dispensed from the bottom of the cup dispenser. Cup dispensers have also utilized a spring element to bias the drinking cups toward an upper end of the cup dispenser so that drinking cups can be dispensed from the top of the cup dispenser. However, there exists a need for a cup dispenser that can simultaneously dispenses cups for a plurality of different dispensing areas or portions of the cup dispenser. Further, there is a need for a cup dispenser that can simultaneously dispense different size drinking cups from a cup dispenser. Moreover, there is a need for a cup dispenser that is readily adjustable, simple to manufacture and simple to use and/or mount in an operating position.

OBJECTS AND SUMMARY OF THE INVENTION

An object of a preferred embodiment of the present invention is to provide a novel and unobvious apparatus for dispensing liquid retaining members.

Another object of a preferred embodiment of the present invention is to provide a novel and unobvious apparatus for dispensing liquid retaining members configured to be mounted on or adjacent a liquid dispensing apparatus.

A further object of a preferred embodiment of the present invention is to provide a cup dispenser for simultaneously dispensing cups from multiple different portions of the cup dispenser.

Still another object of a preferred embodiment of the present invention is to provide a cup dispenser for simultaneously dispensing cups from multiple different portions of the cup dispenser that can be readily mounted on or adjacent a liquid dispensing apparatus.

A further object of a preferred embodiment of the present invention is to provide a cup dispenser for simultaneously dispensing cups from multiple different portions of the cup dispenser having a single biasing means for biasing different stacks of cups towards different dispensing areas or portions of the cup dispenser.

Yet another object of a preferred embodiment of the present invention is to provide a double ended cup dispenser for simultaneously dispensing cups from opposing ends of the double ended cup dispenser.

Still a further object of a preferred embodiment of the present invention is to provide a double ended cup dispenser for simultaneously dispensing different size cups from opposing ends of the double ended cup dispenser.

Yet still another object of a preferred embodiment of the present invention is to provide different size flexible cup retaining and release members that can be positioned adjacent multiple different dispensing locations of a cup dispenser.

Still another object of a preferred embodiment of the present invention is to provide a frame member for detachably supporting a plurality of different size flexible cup retaining and release members.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to a cup dispenser for housing and dispensing a plurality of drinking cups. The cup dispenser includes a first stack of a plurality of drinking cups, a second stack of a plurality of drinking cups and a body simultaneously housing the first stack of a plurality of drinking cups and the second stack of a plurality of drinking cups. The body has a first end and a second end. The first end has a first opening through which drinking cups in the first stack of a plurality of drinking cups can be dispensed one after the other. The second end has a second opening through which drinking cups in the second stack of drinking cups can be dispensed one after the other. The body is configured such that a drinking cup from the first stack of a plurality of drinking cups can be dispensed at the same time a drinking cup in the second stack of a plurality of drinking cups is dispensed.

Another preferred embodiment of the present invention is directed to a double ended cup dispenser for simultaneously dispensing cups at each of two ends of the double ended cup dispenser. The double ended cup dispenser has a housing having first and second ends. The first end of the housing has a first opening through which one or more cups can dispensed. The second end of the housing has a second opening through which one or more cups can be dispensed at substantially the same time cups are dispensed from the first end of the housing. A first cup support member is disposed in the housing for supporting one or more cups. A second cup support member is disposed in the housing for supporting one or more cups. At least one biasing member is configured to bias the first cup support member toward the first end of the housing and bias the second cup support member toward the second end of the housing.

A further preferred embodiment of the present invention is directed to a liquid dispensing apparatus including a liquid dispenser for dispensing one or more liquids and a double ended cup dispenser for simultaneously dispensing cups at each of two ends on the double ended cup dispenser.

BRIEF DESCRIPTION OF THE DRAWINGS

FIG. 14 is a perspective sectional view of a portion of one type of releasable cup retainer formed in accordance with a preferred embodiment of the present invention.

FIG. 15 is a perspective view of the releasable cup retainer depicted in FIG. 14.

FIG. 16 is a fragmentary sectional view of the releasable cup retainer depicted in FIG. 14.

DETAILED DESCRIPTION OF THE PREFERRED EMBODIMENTS OF THE INVENTION

The preferred forms of the invention will now be described with reference to FIGS. 1-19. The appended claims are not limited to the preferred forms and no term and/or phrase used herein is to be given a meaning other than its ordinary meaning unless it is expressly stated otherwise.

FIGS. 1 Through 19

Referring to FIGS. 1 to 19, a preferred form of dispenser A for simultaneously dispensing a plurality of liquid retaining members from a plurality of different areas or portions of dispenser A is illustrated in one of many possible configurations. In the most preferred form, the liquid retaining members are drinking cups.

Preferably, dispenser A has a substantially tubular housing 2 configured to house and simultaneously dispense a first stack of a plurality of drinking cups B and a second stack of a plurality of drinking cups C. While housing 2 of dispenser A is shown as being a straight substantially tubular housing, it will be readily appreciated that housing 2 could be curved. For example, housing 2 could be U-shaped so that cups from each of the two stacks of drinking cups are positioned adjacent each other.

Figure 2:
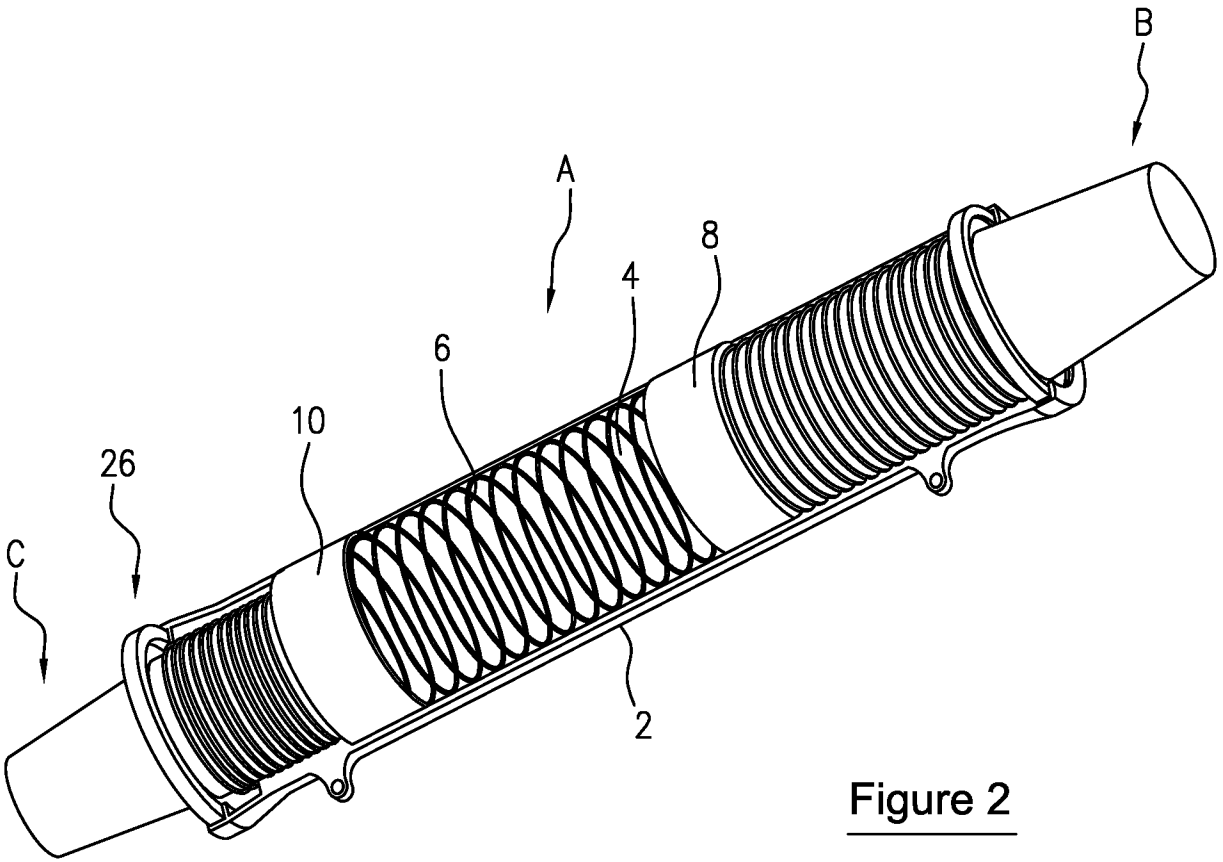
FIG. 2 is a perspective view of the dispenser depicted in FIG. 1 with portions of the housing removed.
Figures 8, 9:
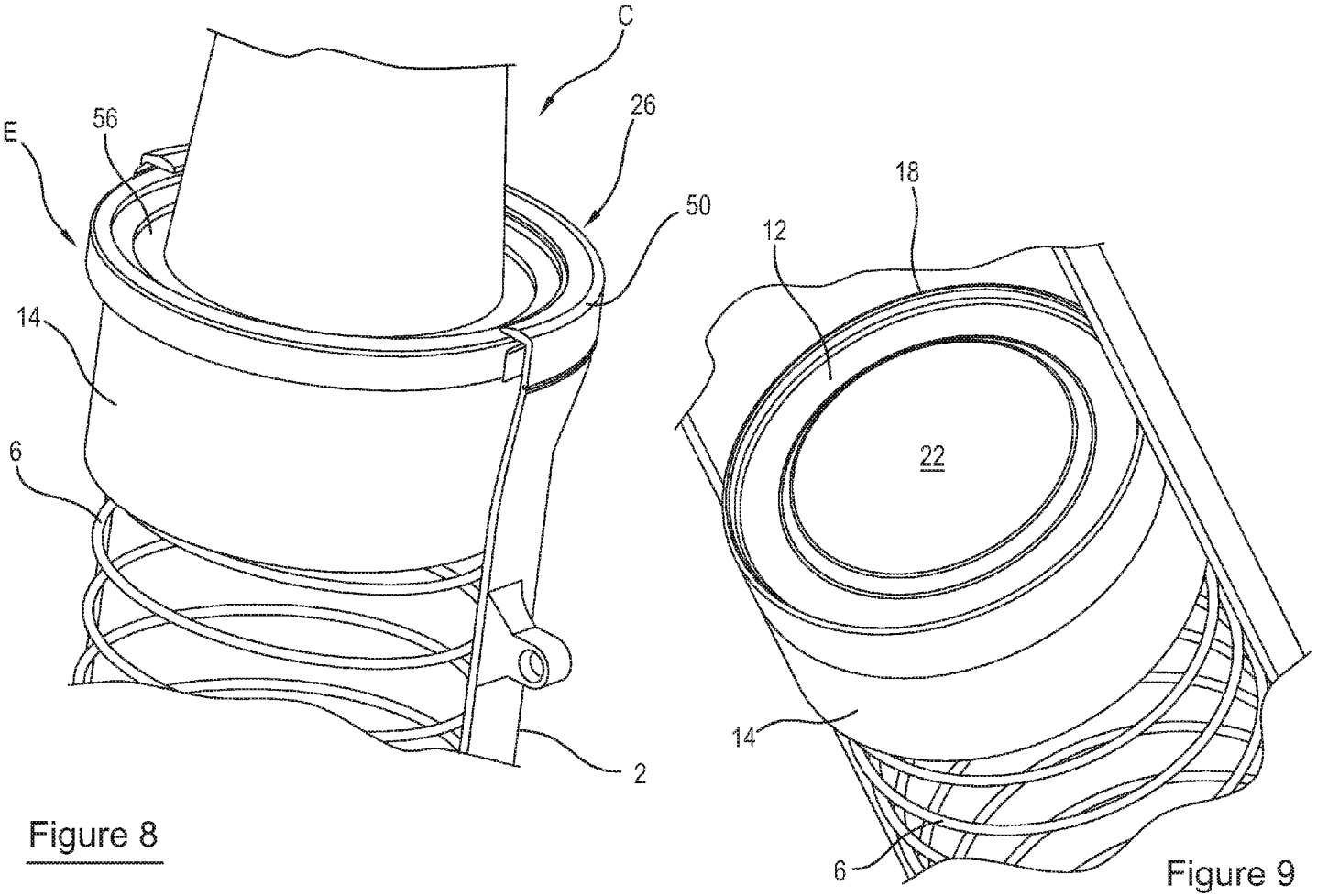
FIG. 8 is a fragmentary perspective view of a portion of the dispenser depicted in FIG. 1.
FIG. 9 is a perspective view of a portion of the dispenser depicted in FIG. 1.
Figure 10:
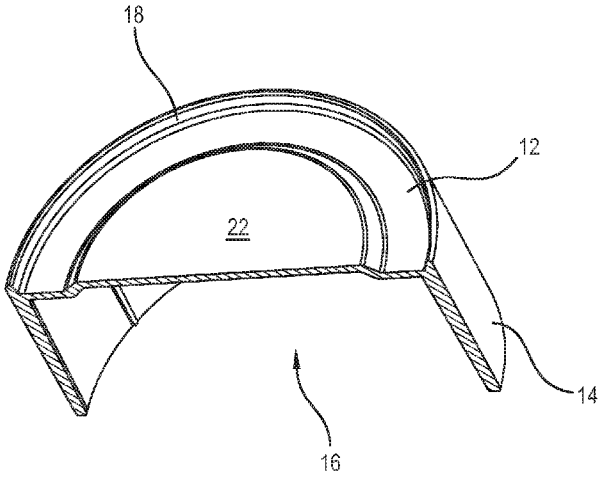
FIG. 10 is a fragmentary perspective view of a cup seat formed in accordance with a preferred embodiment of the present invention.
Figure 11:
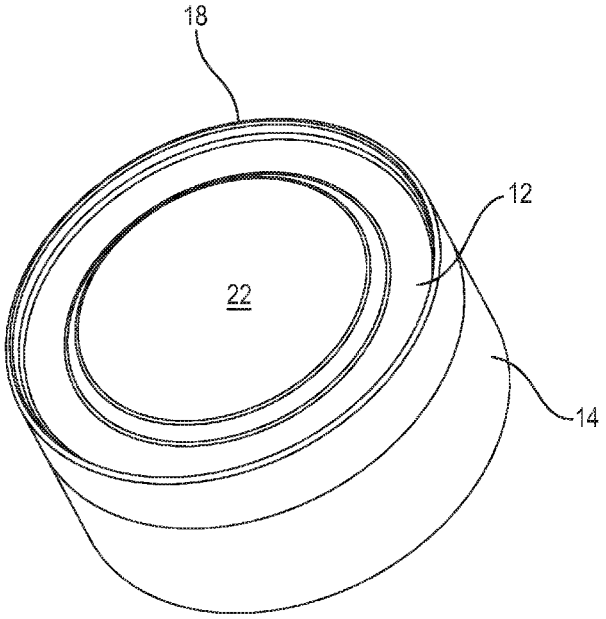
FIG. 11 is a perspective view of a cup seat formed in accordance with a preferred embodiment of the present invention.
Figure 12:
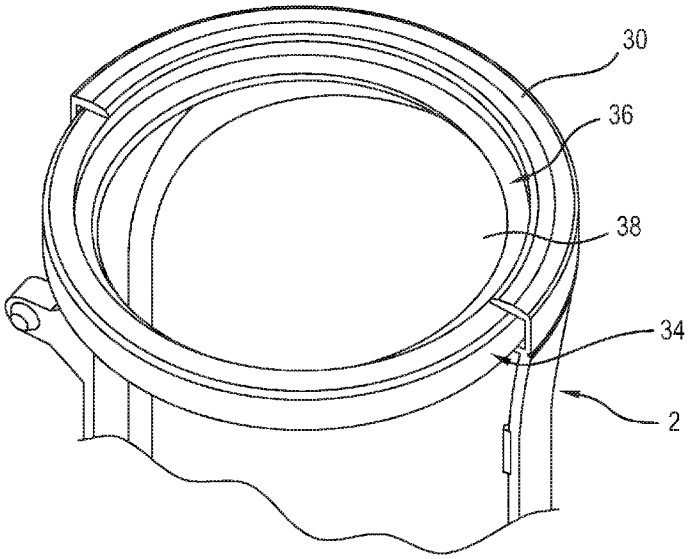
FIG. 12 is a fragmentary perspective view of a portion of the dispenser depicted in FIG. 1 with portions thereof removed.
Figure 13:
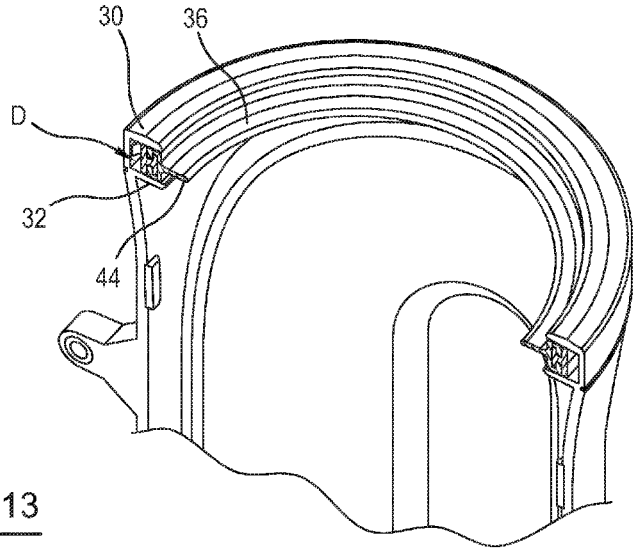
FIG. 13 is a perspective sectional view of a portion of the dispenser depicted in FIG. 1.

Referring to FIG. 2, housing 2 includes a hollow cavity 4 for receiving a single coil spring 6, a first cup seat 8 and a second cup seat 10. Preferably, first cup seat 8 is identical to second cup seat 10. Referring to FIGS. 8 to 12, first cup seat 8 preferably includes a cup support 12, a skirt 14 and a hollow cavity 16. Cup support 12 is recessed inwardly from top surface 18 of skirt 14. Cup support 12 further has a raised center portion 22. Referring to FIGS. 2, 8 and 9, a first end of coil spring 6 extends into hollow cavity 16 and engages an interior surface of cup support 12 of first cup seat 8. Similarly, a second end of coil spring 6 extends into hollow cavity 16 and engages an interior surface of cup support 12 of second cup seat 10. Coil spring 6 acts to bias first cup seat 8 and the corresponding stack B of drinking cups toward end 24 of housing 2 and bias second cup seat 10 and the corresponding stack of drinking cups C toward end 26 of housing 2. While a single coil spring is preferably used to bias outwardly cup supports 8 and 10, the number and type of biasing member used to perform the functions of spring 6 may be varied as desired.

Referring to FIGS. 7, 8 and 12 through 18, the preferred forms of releasable cup retainers D and E will now be described. Preferably, releasable cup retainer D is configured to releasably retain drinking cups of a larger size than releasable cup retainer E. Releasable cup retainer D is seen in, for example, FIGS. 12 through 17 and releasable cup retainer E is seen in, for example, FIGS. 8 and 18.

Figure 7:
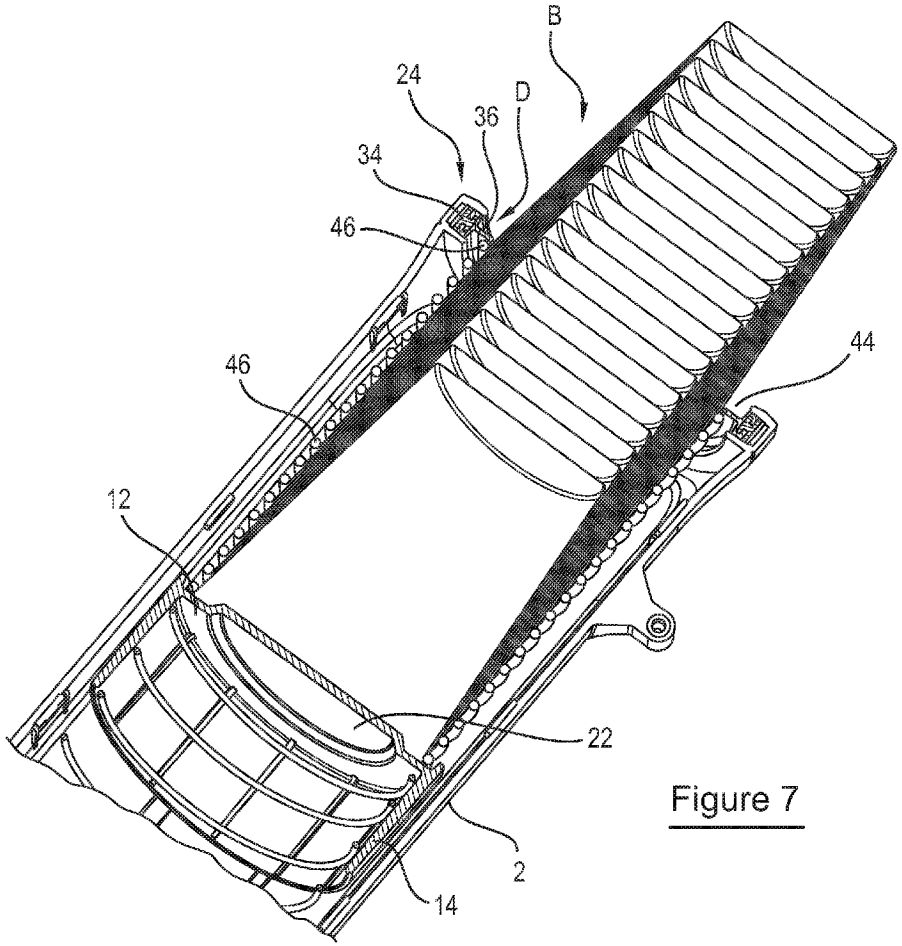
FIG. 7 is a fragmentary cross-sectional view of a portion of the dispenser depicted in FIG. 1.
Figure 6:
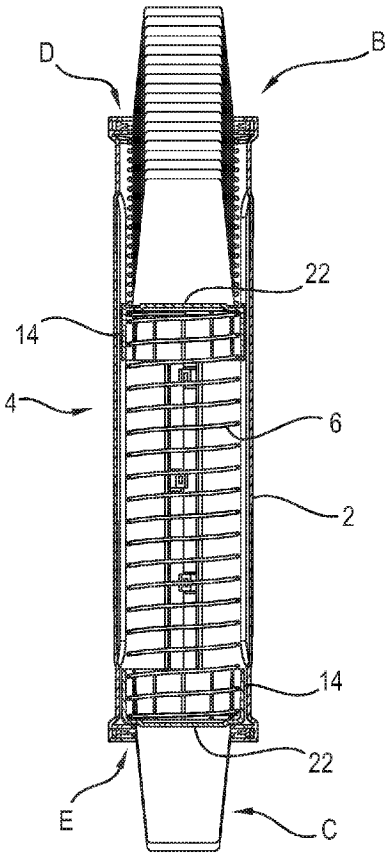
FIG. 6 is a cross-sectional view of the dispenser depicted in FIG. 1 taken along lines 6-6 in FIG. 3.

Referring to FIGS. 12 through 17, end 24 of dispenser A includes inwardly extending wall portions 30 and 32. Wall portion 30 forms the outer wall of housing 2 and is spaced from and extends substantially parallel to inner wall portion 32. Releasable cup retainer D includes a support frame member 34 and a flexible membrane 36 having a substantially central opening 38. Frame 34 seats between wall portions 30 and 32. Preferably, frame 34 is rigid or semi-rigid. Flexible membrane or gasket 36 is preferably detachably connected to frame 34. As seen in FIG. 16, frame 34 preferably includes a substantially T-shaped connecting member 40 and flexible member 36 has a substantially C-shaped connecting member 42 which attaches about and surrounds T-shaped connecting member 40. Preferably, flexible membrane 36 preferably includes an enlarged engaging portion 44 for engaging a lip 46 or other structure of a drinking cup as seen in FIG. 7. Pulling on the exposed cup in stack B distorts member 36 such that it moves outwardly thereby allowing a single drinking cup to be dispensed. Upon removal of the drinking cup from dispenser A, the flexible nature of membrane 36 causes membrane 36 to spring back or return to its original position prior to application of a removal force on the drinking cup. This causes engaging portion 44 to engage lip 46 of the next drinking cup in stack B to ensure that only a single drinking cup is dispensed from end 24 at a given time.

Figure 18:
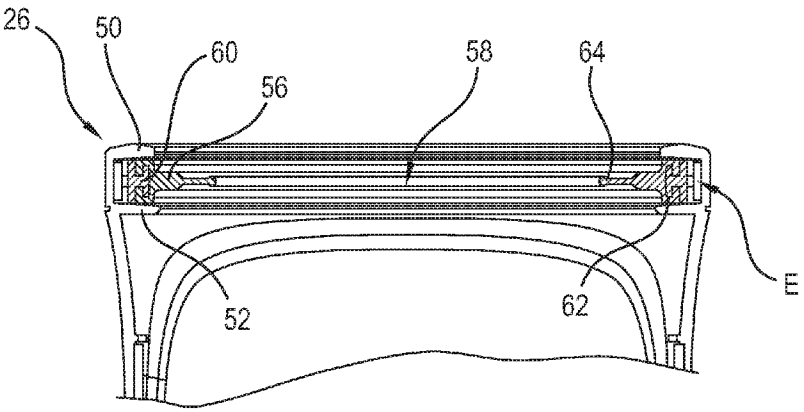
FIG. 18 is a cross-sectional view of the other end of the dispenser depicted in FIG. 1.

Referring to FIGS. 8 and 18, end 26 of dispenser A includes inwardly extending wall portions 50 and 52. Wall portion 50 is preferably identical to wall portion 30 and wall portion 52 is preferably identical to wall portion 32. Wall portion 50 forms the outer wall of housing 2 and is spaced from inner wall portion 52 the same distance that wall portion 30 is spaced from wall portion 32. Releasable cup retainer E includes a support frame member 54 that is identical to support frame member 34. Accordingly, either support frame member may be positioned at either end of dispenser A. Frame 54 seats between wall portions 50 and 52.

Figure 17:
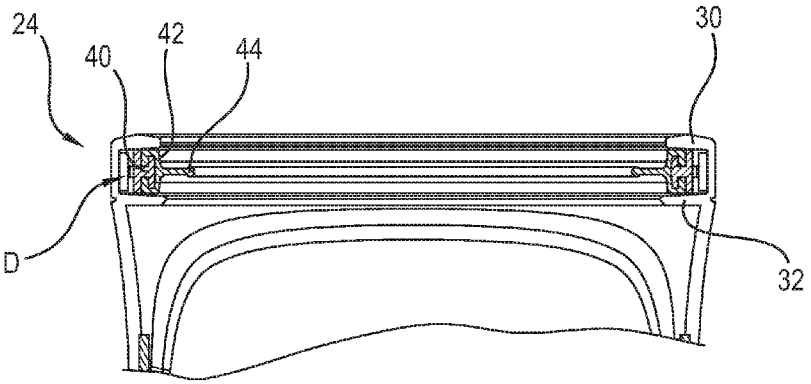
FIG. 17 is a cross-sectional view of one end of the dispenser depicted in FIG. 1.

Releasable cup retainer E further includes a flexible membrane 56 having a substantially central opening 58. Flexible membrane 56 is preferably detachably connected to frame 54. As seen in FIG. 18, frame 54 preferably includes a substantially T-shaped connecting member 60 that is identical to T-shaped connecting member 40. Preferably, flexible member 56 has a substantially C-shaped connecting member 62 which is similar or identical to C-shaped connecting member 42. Accordingly, either flexible membrane can be used with either frame support member. Referring to FIGS. 17 and 18, flexible membrane 56 has a smaller central opening than flexible membrane 36 to allow flexible member 56 to releasably retain smaller drinking cups than membrane 36.

Flexible membrane 56 preferably includes an enlarged engaging portion 64 for engaging a lip 46 or other structure of a drinking cup. Pulling on the exposed cup in stack C distorts member 56 such that it moves outwardly thereby allowing a single drinking cup to be dispensed. Upon removal of the drinking cup from dispenser A, the flexible nature of membrane 56 causes membrane 56 to spring back or return to its original position prior to application of a removal force on the drinking cup. This causes engaging portion 64 to engage lip 46 of the next drinking cup in stack C to ensure that only a single drinking cup is dispensed from end 26 at a given time.

Figure 1:
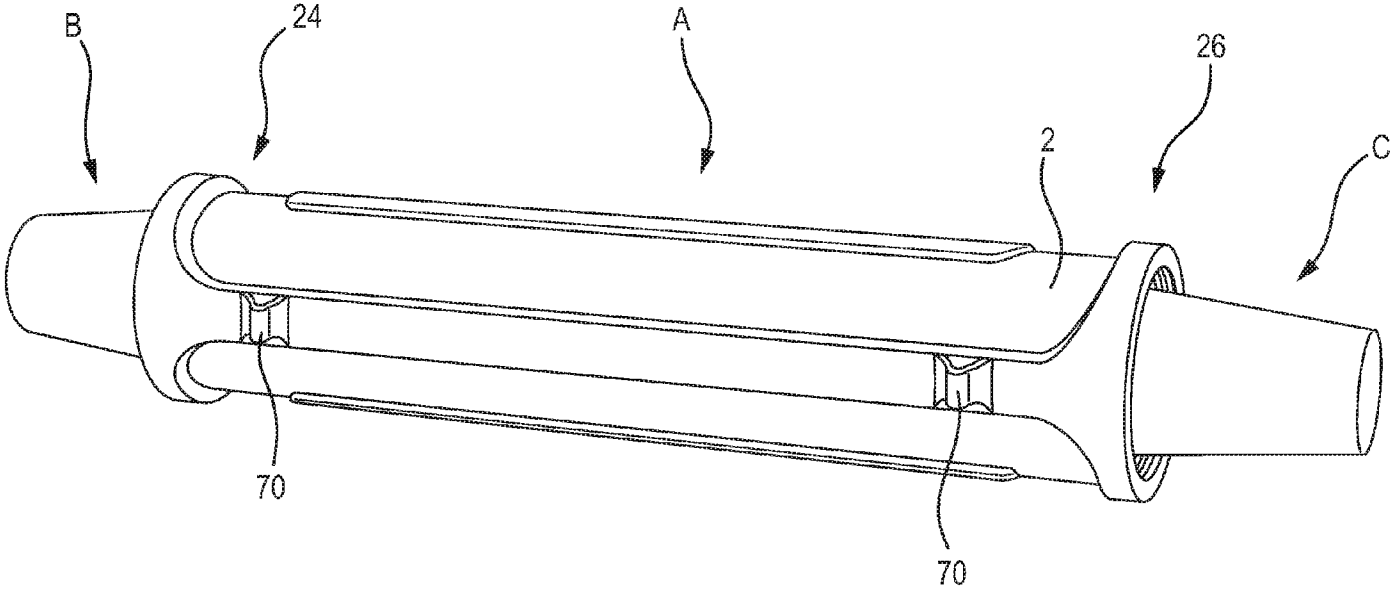
FIG. 1 is a perspective view of a dispenser for dispensing liquid retaining members formed in accordance with a preferred embodiment of the present invention.
Figure 19:
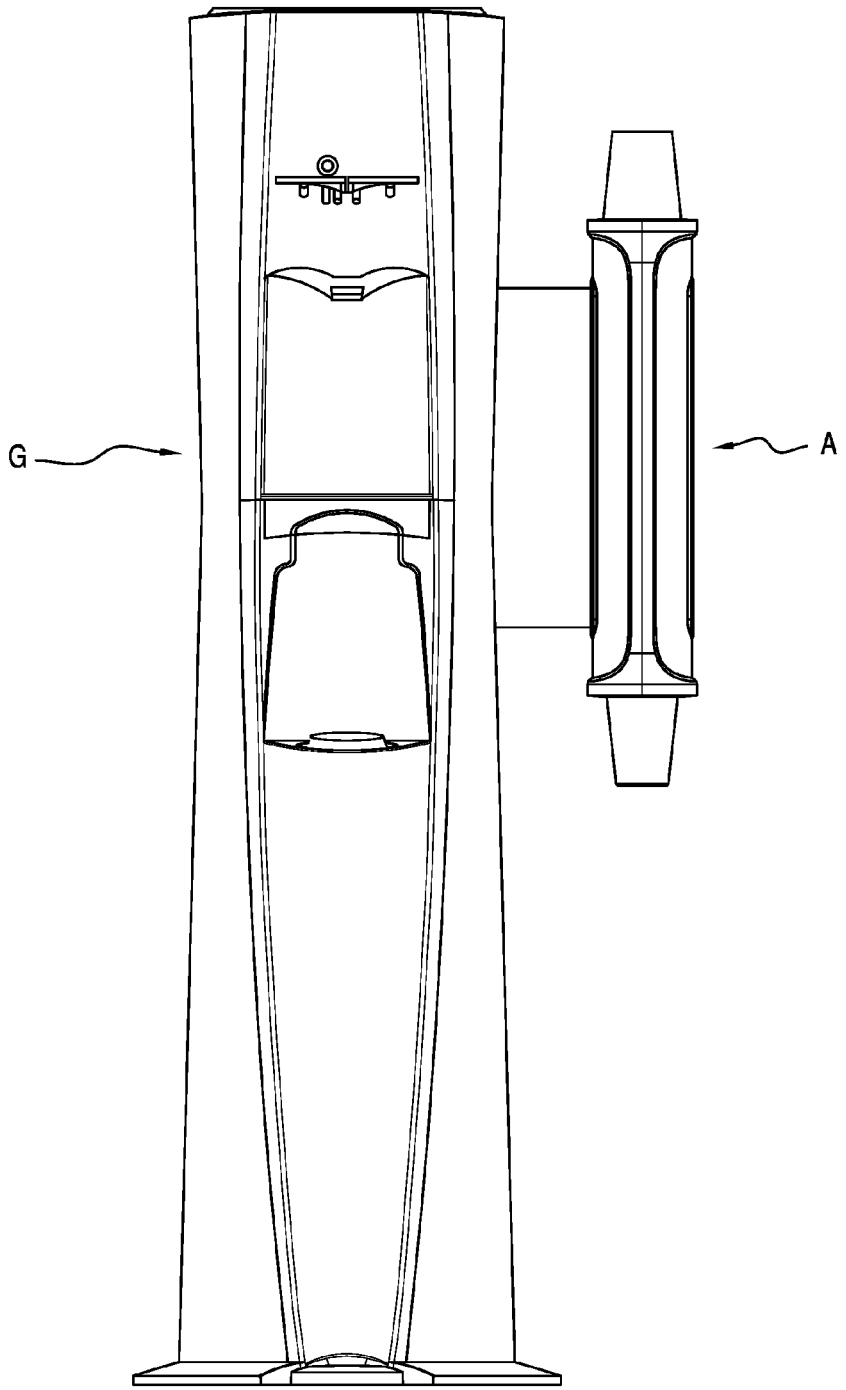
FIG. 19 is an elevational view of a dispenser for dispensing liquid retaining members mounted on a liquid dispenser.

Referring to FIGS. 1 and 2, housing 2 may be provided with one or more mounting members 70 for facilitating mounting of dispenser A in a desired location. For example, as seen in FIG. 19, dispenser A may be mounted on dispenser G. Dispenser G can dispense any flowable material or liquid including but not limited to chilled water, hot water, soda, coffee, tea, etc. Preferably, dispenser G is a water cooler for dispensing water. The water cooler can be used with a bottom loaded five gallon water bottle, an inverted five gallon water bottle or a water cooler using bags or other non-bottle type water containers.

Figure 3:
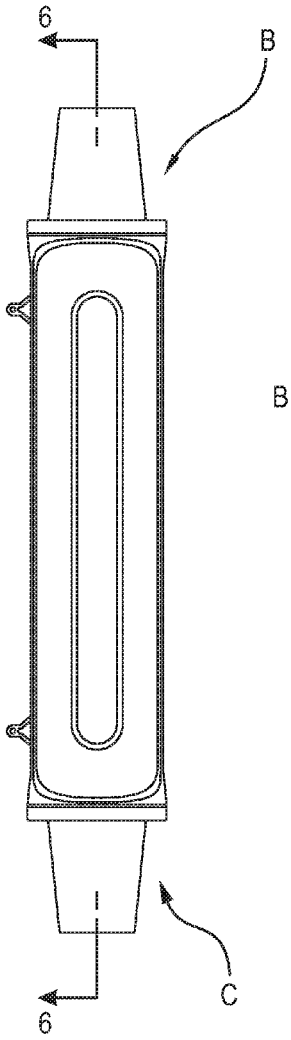
FIG. 3 is an elevational view of the dispenser depicted in FIG. 1.
Figure 4:
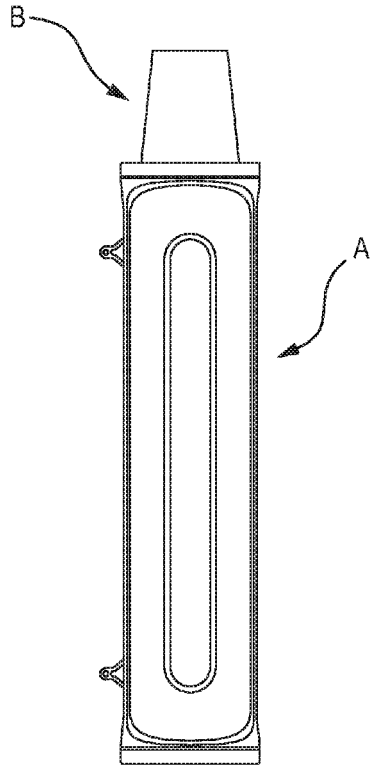
FIG. 4 is an elevational view of the dispenser depicted in FIG. 1 with a single stack of large drinking cups positioned to be dispensed from the top of the dispenser.
Figure 5:
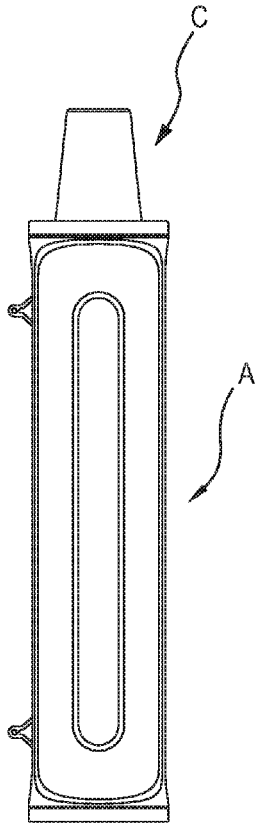
FIG. 5 is an elevational view of the dispenser depicted in FIG. 1 with a single stack of small drinking cups positioned to be dispensed from the top of the dispenser.

The preferred form of cup dispenser A is extremely versatile. First, it can simultaneously dispense two cups from two different dispensing areas of dispenser A. Also, the cups dispensed simultaneously from the two different dispensing areas can be of two different sizes (e.g., large cup and small cup). The preferred form of cup dispenser A can be mounted horizontally, vertically or in some other manner as dispenser A does not depend on gravity to aid cup dispensing. Referring to FIG. 3, dispenser A can be used to dispense two sets of stacked cups (as seen in FIG. 3) with larger cups dispensed from the top and smaller cups dispensed from the bottom. Where dispenser A has not yet been mounted, smaller cups can be dispensed from the top by simply rotating dispenser A 180 degrees from the orientation shown in FIG. 3. Where dispenser A has already been mounted on a liquid dispenser or another mounting surface, one need only switch the flexible membranes 36 and 56 to switch which ends dispense the larger and smaller drinking cups. Referring to FIGS. 4 and 5, dispenser A can be used to dispense a stack of drinking cups from only one end. FIG. 4 depicts an orientation in which the larger drinking cups are dispensed from the top while FIG. 5 shows dispenser A rotated 180 degrees from the orientation in FIG. 4 to dispense the smaller drinking cups from the top. It should be noted that cups seats 8 and 10 act with the corresponding flexible membrane to seal off the ends of the dispenser A when no cups are present at an end of dispenser A.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A cup dispenser for housing and dispensing a plurality of drinking cups, said cup dispenser including:

(a) a first stack of a plurality of drinking cups, a second stack of a plurality of drinking cups and a body simultaneously housing said first stack of a plurality of drinking cups and said second stack of a plurality of drinking cups, each cup in said first stack of a plurality of drinking cups being larger than each cup in said second stack of a plurality of drinking cups, said body having a first end and a second end and a hollow cavity extending between said first end and said second end, said first end having a first opening through which drinking cups in said first stack of a plurality of drinking cups can be dispensed one after the other, said second end having a second opening through which drinking cups in said second stack of drinking cups can be dispensed one after the other, said first opening being larger than said second opening;

(b) said body being configured such that a drinking cup from said first stack of a plurality of drinking cups can be dispensed at the same time a drinking cup in said second stack of a plurality of drinking cups is dispensed;

(c) a first releaseable cup retainer including a first frame and a first flexible membrane detachably connected to said first frame, said first frame supports said first flexible membrane and said first flexible membrane includes an engaging portion that engages a corresponding drinking cup in said first stack of a plurality of drinking cups, said first flexible membrane being disposed in said hollow cavity between said first end and said second end of said body, and said first frame and said body being separate pieces and said first frame being disposed in said hollow cavity of said body;

(d) a second releaseable cup retainer including a second frame and a second flexible membrane detachably connected to said second frame, said second frame supports said second flexible membrane and said second flexible membrane engages a corresponding drinking cup in said second stack of a plurality of drinking cups, said second flexible membrane being disposed in said hollow cavity between said first end and said second end of said body, and said second frame and said body being separate pieces and said second frame being disposed in said hollow cavity of said body; and, (e) at least one biasing member for biasing a first cup support member toward a first end of said body and biasing a second cup support member toward a second end of said body.

2. The cup dispenser of claim 1, wherein:

(a) said at least one biasing member extends between said first stack of a plurality of drinking cups and said second stack of a plurality of drinking cups, said at least one biasing member being configured to urge said first stack of a plurality of drinking cups in a first direction and urge said second stack of a plurality of drinking cups toward said first end of said body and urge said second stack of a plurality of drinking cups toward said second end of said body.

3. The cup dispenser of claim 2, wherein:

(a) said at least one biasing member is a single spring.

4. The cup dispenser of claim 3, wherein (a) said spring is disposed between said first cup support member and said second cup support member.

5. The cup dispenser of claim 4, wherein:

(a) said first cup seat includes a drinking cup support surface, a skirt and a first hollow cavity;

(b) said second cup seat includes a drinking cup support surface, a skirt and a second hollow cavity; and, (c) said spring is a coil spring having first and second ends, said first end of said coil spring extends into said first hollow cavity and said second end of said coil spring extends into said second hollow cavity.

6. A double ended cup dispenser for simultaneously dispensing cups at each of two ends of the double ended cup dispenser, said double ended cup dispenser comprising:

(a) a housing having first and second ends and a body having a hollow cavity extending between said first and second ends, said first end of said housing having a first opening through which one or more cups can be dispensed, said second end of said housing having a second opening through which one or more cups can be dispensed at substantially the same time cups are dispensed from said first end of said housing;

(b) a first cup support member being disposed in said hollow cavity of said body of said housing for supporting one or more cups;

(c) a second cup support member being disposed in said body of said hollow cavity of said housing for supporting one or more cups;

(d) at least one biasing member for biasing said first cup support member toward said first end of said housing and biasing said second cup support member toward said second end of said housing;

(e) a first releaseable cup retainer being disposed in said hollow cavity between said first and second ends of said housing, said first releaseable cup retainer having a first frame and a first flexible member and wherein said first frame and said body are separate pieces, at least a portion of said first releaseable cup retainer being detachably connected adjacent said first end of said housing, said first releaseable cup retainer being configured to releasably retain cups in a first stack of a plurality of cups;

(f) a second releaseable cup retainer being disposed in said hollow cavity between said first and second ends of said housing, said second releaseable cup retainer having a second frame and a second flexible member and wherein said second frame and said body are separate pieces, at least a portion of said second releaseable cup retainer being detachably connected adjacent said second end of said housing, said second releaseable cup retainer being configured to releasably retain cups in a second stack of a plurality of cups;

(g) said housing includes first and second wall portions disposed adjacent said first end of said housing, said first and second wall portions extending inwardly toward a center of said housing, said first frame and said first flexible member being disposed in a space formed between said first wall portion and said second wall portion, said first frame supports said first flexible member such that said first flexible member can be detached from said first frame and said first flexible member includes an engaging member that engages a corresponding cup in said first stack of a plurality of cups; and, (h) said housing includes third and fourth wall portions disposed adjacent said second end of said housing, said third wall portion and said fourth wall portion extending inwardly toward a center of said housing, said second frame and said second flexible member being disposed in a space formed between said third wall portion and said fourth wall portion, said second frame supports said second flexible member such that said second flexible member can be detached from said second frame and said second flexible member engages a corresponding cup in said second stack of a plurality of cups wherein said first frame and said second frame are identical and said first flexible member and said second flexible member are different.

7. The double ended cup dispenser of claim 6, wherein:

(a) said first end of said housing is disposed below said second end of said housing.

8. The double ended cup dispenser of claim 7, wherein:

(a) said at least one biasing member is a single coil spring.

9. The double ended cup dispenser of claim 8, wherein:

(a) said housing is substantially tubular and an axis passing through a center of said first opening passes through a center of said second opening.

10. The double ended cup dispenser of claim 9, wherein:

(a) said housing includes at least one mounting member for mounting the housing on or adjacent a liquid dispenser in at least two different orientations wherein in a first orientation the first end of the housing is positioned above the second end of the housing and in a second orientation the first end of the housing is positioned below the second end of the housing.

11. The double ended cup dispenser of claim 10, wherein:

(a) an opening of each cup in said second stack of a plurality of cups faces an opening in each cup of said first stack of a plurality of cups.

12. The double ended cup dispenser of claim 11, wherein:

(a) said first opening is formed in a portion of said first flexible member of said first releaseable cup retainer detachably connected to said housing; and, (b) said second opening is formed in a portion of said second flexible member of said second releaseable cup retainer detachably connected to said housing and said first opening and said second opening are different sizes.

13. The double ended cup dispenser of claim 6, wherein:

(a) said first flexible member has an opening sized to engage a first sized cup and said second flexible member has an opening sized to engage a cup larger than said first sized cup.

14. A double ended cup dispenser for simultaneously dispensing cups at each of two ends of the double ended cup dispenser, said double ended cup dispenser comprising:

(a) a housing having first and second ends, said first end of said housing having a first opening through which one or more cups can dispensed, said second end of said housing having a second opening through which one or more cups can be dispensed at substantially the same time cups are dispensed from said first end of said housing;

(b) a first cup support member being disposed in said housing for supporting one or more cups;

(c) a second cup support member being disposed in said housing for supporting one or more cups;

(d) at least one biasing member for biasing said first cup support member toward said first end of said housing and biasing said second cup support member toward said second end of said housing;

(e) said first end of said housing is disposed below said second end of said housing;

(f) said at least one biasing member is a single coil spring;

(g) said housing is substantially tubular and an axis passing through a center of said first opening passes through a center of said second opening;

(h) said housing includes at least one mounting member for mounting the housing on or adjacent a liquid dispenser in at least two different orientations wherein in a first orientation the first end of the housing is positioned above the second end of the housing and in a second orientation the first end of the housing is positioned below the second end of the housing;

(i) a first stack of a plurality of cups disposed in said housing adjacent said first end of said housing;

(j) a second stack of a plurality of cups disposed in said housing adjacent said second end of said housing wherein an opening of each cup in said second stack of a plurality of cups faces an opening in each cup of said first stack of a plurality of cups;

(k) a first releaseable cup retainer at least a portion of which is detachably connected to said housing, said first releaseable cup retainer being configured to releasably retain cups in said first stack of a plurality of cups;

(l) a second releaseable cup retainer at least a portion of which is detachably connected to said housing, said second releaseable cup retainer being configured to releasably retain cups in said second stack of a plurality of cups;

(m) said first releaseable cup retainer includes a first frame and a first flexible membrane, said first frame supports said first flexible membrane and said first flexible membrane includes an engaging member that engages a corresponding cup in said first stack of a plurality of cups;

(n) said second releaseable cup retainer includes a second frame and a second flexible membrane, said second frame supports said second flexible membrane and said second flexible membrane engages a corresponding cup in said second stack of a plurality of cups wherein said first frame and said second frame are identical;

(o) said first flexible membrane is sized to engage a first sized cup and said second flexible membrane is sized to engage a cup larger than said first sized cup;

(p) said first flexible membrane is configured such that said first flexible membrane can be detachably connected to either said first frame or said second frame; and, (q) said second flexible membrane is configured such that said second flexible membrane can be detachably connected to either said first frame or said second frame.

15. A liquid dispensing apparatus, said liquid dispensing apparatus including:

(a) a liquid dispenser for dispensing one or more liquids;

(b) a double ended cup dispenser for simultaneously dispensing cups at each of first and second ends of said double ended cup dispenser, said double ended cup dispenser further including a body having a hollow cavity extending between said first and second ends;

(c) a first releaseable cup retainer being disposed in said hollow cavity and at least a portion of said first releasable cup retainer being detachably connected adjacent said first end, said first releaseable cup retainer being configured to releasably retain cups in a first stack of a plurality of cups, said first releaseable cup retainer having a first frame and a first flexible member and wherein said first frame and said body are separate pieces;

(d) a second releaseable cup retainer being disposed in said hollow cavity and at least a portion of said second releasable cup retainer being detachably connected adjacent said second end, said second releaseable cup retainer being configured to releasably retain cups in a second stack of a plurality of cups, said second releaseable cup retainer having a second frame and a second flexible member and wherein said second frame and said body are separate pieces (e) said body including first and second wall portions disposed adjacent said first end of said body, said first and second wall portions extending inwardly toward a center of said body, said first frame and said first flexible member being disposed in a space formed between said first wall portion and said second wall portion, said first frame supports said first flexible member such that said first flexible member can be detached from said first frame and said first flexible member includes an engaging member that engages a corresponding cup in said first stack of a plurality of cups; and, (f) said body including third and fourth wall portions disposed adjacent said second end of said body, said third wall portion and said fourth wall portion extending inwardly toward a center of said body, said second frame and said second flexible member being disposed in a space formed between said third wall portion and said fourth wall portion, said second frame supports said second flexible member such that said second flexible member can be detached from said second frame and said second flexible member engages a corresponding cup in said second stack of a plurality of cups wherein said first frame and said second frame are identical and said first flexible member and said second flexible member are different; and, (g) at least one biasing member for biasing a first cup support member toward a first end of said double ended cup dispenser and biasing a second cup support member toward a second end of said double ended cup dispenser.

16. The liquid dispensing apparatus of claim 15, wherein:

(a) said liquid dispenser includes a housing and said double ended cup dispenser is connected to said housing.

17. The liquid dispensing apparatus of claim 16, wherein:

(a) said double ended cup dispenser includes a substantially tubular housing having first and second ends, the first stack of a plurality of cups are housed in said substantially tubular housing, the second stack of a plurality of cups are housed in said substantially tubular housing and at least one biasing element biasing said first stack of a plurality of cups towards said first end of said substantially tubular housing and biasing said second stack of a plurality of cups toward said second end of said substantially tubular housing.

* * * * *